United States Patent [19]

St. Germain

[11] Patent Number: 5,067,389

[45] Date of Patent: Nov. 26, 1991

[54] LOAD CHECK AND PRESSURE COMPENSATING VALVE

[75] Inventor: Gene R. St. Germain, Plainfield, Ill.

[73] Assignee: Caterpillar Inc., Peoria, Ill.

[21] Appl. No.: 574,864

[22] Filed: Aug. 30, 1990

[51] Int. Cl.[5] ..... F15B 11/08

[52] U.S. Cl. ..... 91/446; 91/444; 91/445; 91/447; 91/448; 60/427; 60/445; 60/452; 137/596

[58] Field of Search ..... 137/596, 596.13; 60/420, 423, 426, 427, 450, 452; 91/446, 448, 447, 517, 518, 531

[56] References Cited

U.S. PATENT DOCUMENTS

| | | | |
|---|---|---|---|
| 2,618,121 | 11/1952 | Tucker | 91/447 |
| 3,470,694 | 10/1969 | Budzick | 91/518 X |
| 3,534,774 | 10/1970 | Tennis | 137/596 |
| 3,878,864 | 4/1975 | Schurger | 137/596.13 |
| 3,995,425 | 12/1976 | Wittren | 60/452 X |
| 4,111,283 | 9/1978 | Hastings, Jr. | 91/447 X |
| 4,282,898 | 8/1981 | Harmon et al. | 137/596.13 |
| 4,343,152 | 8/1982 | Habiger | 60/452 |
| 4,352,375 | 10/1982 | Williams | 37/596.13 |
| 4,361,169 | 11/1982 | Williams | 137/596.13 |
| 4,436,114 | 3/1984 | Kötter | 60/427 X |
| 4,693,272 | 9/1987 | Wilke | 137/596 |
| 4,736,770 | 4/1988 | Rousset et al. | 137/596.13 X |
| 4,787,294 | 11/1988 | Bowden | 91/447 |
| 4,938,022 | 7/1990 | Hirata et al. | 60/426 |
| 4,958,553 | 9/1990 | Ueno | 91/447 |
| 4,986,071 | 1/1991 | Voss et al. | 60/427 X |

FOREIGN PATENT DOCUMENTS

| | | |
|---|---|---|
| 0251172 | 1/1988 | European Pat. Off. . |
| 2183825 | 12/1973 | France . |
| 2300278 | 9/1976 | France . |
| 2339078 | 8/1977 | France . |

*Primary Examiner*—Edward K. Look
*Assistant Examiner*—Todd Mattingly
*Attorney, Agent, or Firm*—John W. Grant

[57] ABSTRACT

Pressure compensating valves located downstream of the directional control valves are useful in providing load independent, proportional flow control hydraulic systems and normally serve as load checks. The subject load check and pressure compensating valve is designed for use in a hydraulic system in which the pressure of a common pressure signal directed to all the pressure compensating valves of the system is limited to a predetermined maximum level. The pressure compensating valve includes a valve element disposed downstream of a metering orifice, a separate load piston disposed in end-to-end relationship with the valve element in a common bore and a pressure compensating spring disposed in a chamber behind the load piston and biasing the load piston and valve element to the load check position. The common pressure signal is communicated to the chamber containing the spring while the actual load pressure of an associated hydraulic motor is directed to a chamber between the valve element and load piston so that the valve element is held in the load check position by the actual load pressure when the actual load pressure is greater than the pump discharge pressure.

9 Claims, 1 Drawing Sheet

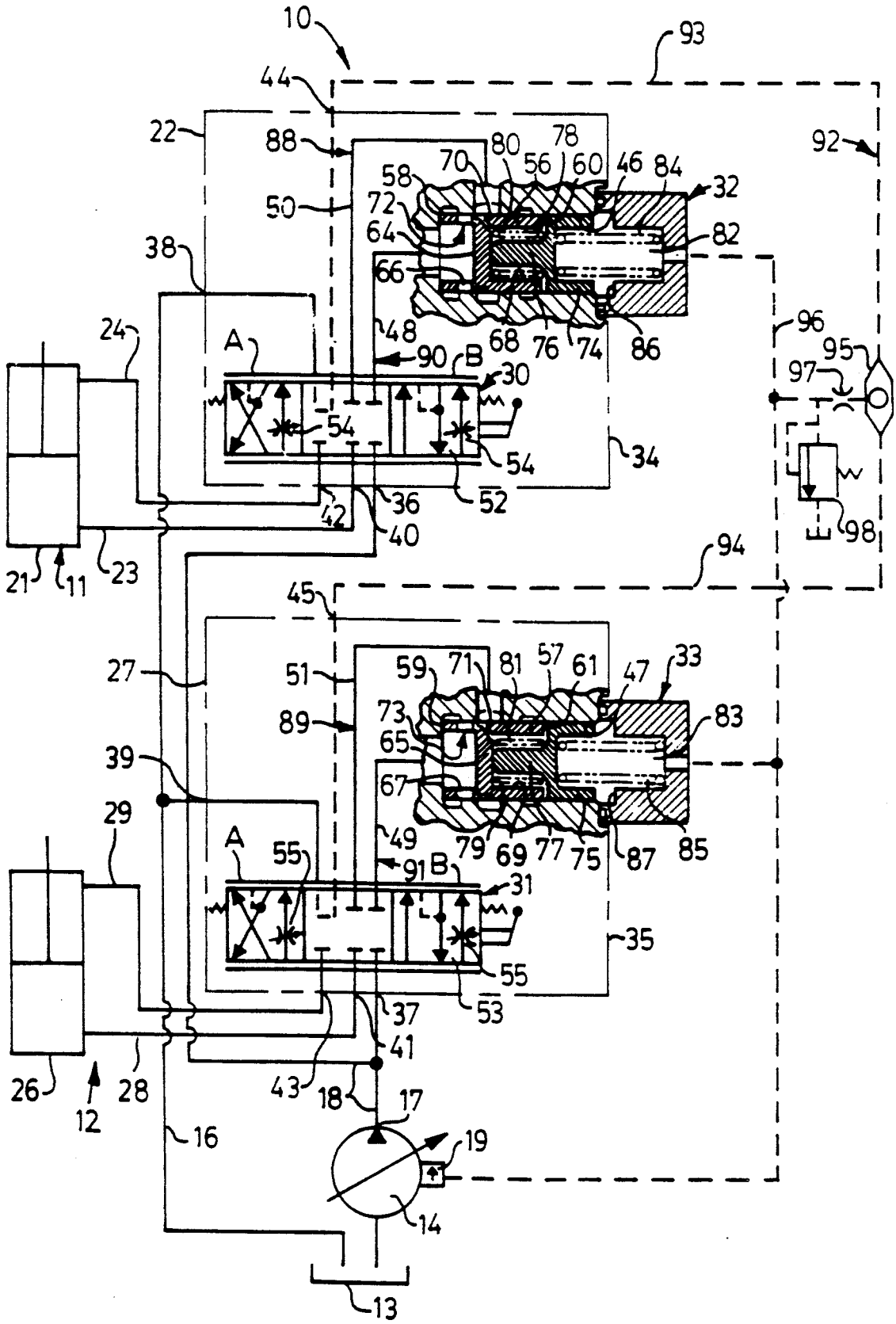
10
93
44
22
88
80
78
70
56
60
46
84
92
58
32
50
72
64
82
38
66
96
24
48
68
76
74
86
95
A
90
B
30
97
54
54
34
36
52
42
40
98
21
11
23
94
45
27
51
59
71
81
57
61
47
33
73
83
89
65
39
67
29
49
79
69
77
75
87
85
A
55
91
B
31
35
55
37
53
41
26
28
43
18
17
12
16
19
14
13

LOAD CHECK AND PRESSURE COMPENSATING VALVE

TECHNICAL FIELD

This invention relates generally to a pressure responsive hydraulic system and more particularly to a control valve having a combined load check and pressure compensating valve for use in such system.

BACKGROUND ART

Load sensing hydraulic systems of the load independent, proportional flow control type commonly have the pressure compensating valves located downstream of the metering orifice in the directional control valve. A load pressure signal network normally connects the highest load pressure to the spring chambers of all the pressure compensating valves. This signal arrangement provides the "proportional priority" feature which proportions the flow to the hydraulic motors regardless of load pressures or the number of hydraulic motors being actuated. In order to allow operation of one or more of the hydraulic motors to continue, even if another of the hydraulic motors has stalled due to excessive load imposed thereon, a signal orifice and signal relief valve are incorporated to limit the pressure of the fluid being directed to the spring chambers to a predetermined maximum level which could be lower than the highest load pressure. This then creates a condition in which the pump discharge pressure is limited to a predetermined maximum with the pump discharge pressure being greater than the pressure of the fluid in the spring chambers by a predetermined margin. Without the signal orifice and relief valve, all the hydraulic motors would stop moving when one stalled.

Normally, the pressure compensating valve functions as a load check to prevent reverse fluid flow therethrough and to thereby prevent the load from drifting downward. However, one of the problems encountered with such signal orifice and relief valve arrangement was that pressurized fluid from one of the hydraulic motors could flow backwards through the associated pressure compensating valve and directional control valve resulting in load drift under certain operating conditions. For example, many industrial or earthmoving vehicles have two or more movable components controlled by hydraulic motors. Some of those components are arranged such that movement of one component can induce in the hydraulic motor connected to another component a load generated pressure greater than the predetermined maximum pump discharge pressure. If the directional control valve associated with the motor having such a load generated pressure therein is moved to an operating position, the pump generated pressure would open the pressure compensating valve which would then allow the fluid from the motor to flow backwards therethrough and through the directional control valve and be used by another one of the motors being actuated.

The present invention is directed to overcoming one or more of the problems set forth above.

DISCLOSURE OF THE INVENTION

In one aspect of the present invention, a control valve is provided for use in a hydraulic system having at least one other control valve therein, at least one hydraulic motor connected to each of the control valves, a load pressure signal network operatively connected to the motors and having a control pressure line which receives the highest load pressure occurring at the motors, and means for limiting the pressure of the fluid in the control pressure line to a predetermined maximum level. The control valve comprises an inlet port; a pair of service passages connected to the associated hydraulic motor; a valve member movable in opposite directions from a neutral position to infinitely variable operating positions; a load check and pressure compensating valve element movable from a load check position to an infinitely variable operating position; means defining a flow control flow path from the inlet port to one of the service passages when the valve member and the valve element are at operating positions wherein the flow path includes a metering orifice and a pressure control orifice disposed in series flow relationship downstream of the metering orifice, the size of the metering orifice being determined by the extent to which the valve member is moved from the neutral position and the size of the pressure control orifice being determined by the extent to which the valve element is moved from the load check position with the valve element being moved to the operating position by fluid passing through the metering orifice; a load piston normally biasing the valve element to the load check position; a first variable volume chamber between the valve element and the load piston; a second variable volume chamber defined in part by the load piston and being connected to the control pressure line; a spring disposed in the second chamber biasing the load piston toward the valve element and hence biasing the valve element to the load check position; and means for communicating load pressure from the one service passage into the first chamber.

BRIEF DESCRIPTION OF THE DRAWINGS

The sole figure is a schematic illustration of an embodiment of the present invention.

BEST MODE FOR CARRYING OUT THE INVENTION

Referring to the drawing, a pressure responsive hydraulic system 10 includes a pair of work circuits 11,12, a tank 13, a load sensing variable displacement pump 14 connected to the tank 13, and an exhaust conduit 16 connected to the tank 13 and both of the work circuits 11,12. The pump 14 has a discharge port 17 connected to the work circuits 11,12 in a parallel flow relationship through a common supply conduit 18. The pump includes a pressure responsive displacement controller 19 for controlling fluid flow through the discharge port 17 and supply conduit 18.

The work circuit 11 includes a double acting hydraulic motor 21 and a control valve 22 connected thereto through a pair of motor conduits 23,24. The work circuit 12 similarly includes a double acting hydraulic motor 26 and a control valve 27 connected thereto through a pair of motor conduits 28,29. Both control valves are connected to the supply conduit 18 and to the exhaust conduit 16.

The control valves 22 and 27 are substantially identical and thus only the control valve 22 will be described in detail with the corresponding elements of the control valve 27 having the next consecutive reference numeral. The control valve 22 includes a directional control valve section schematically illustrated at 30 and a combined load check and pressure compensating valve diagrammatically illustrated at 32, both of which are housed in a common body 34. The body 34 has an inlet port 36 connected to the supply conduit 18, an exhaust port 38 connected to the exhaust conduit 16, a pair of service passages 40,42, connected to the motor conduits 23,24, respectively, and a load pressure signal port 44 primarily associated with the directional control valve 30. The body also has a bore 46 primarily associated with the load check and pressure compensating valve 32, a transfer passage 48 connecting the directional control valve with the bore 46 and a return passage 50 connecting the bore 46 with the directional control valve.

The directional control valve 30 includes a valve member generally indicated at 52 and an infinitely variable metering orifice 54. The valve member is movable from the neutral position shown to first and second infinitely variable operating positions A and B with the size of the metering orifice 54 being controlled by the extent to which the valve member is moved from the neutral position.

The load check and pressure compensating valve 32 includes a valve element 56 slidably disposed in the bore and having opposite ends 58,60 with the first end 58 being subjected to the pressurized fluid in the transfer passage 48. The end 58 includes a recess 64. A plurality of radially extending passages 66 communicate the recess 64 with the outer peripheral surface of the valve element 56. The end 60 includes a recess 68 with the valve element 56 having at least one diagonally extending passage 70 continuously communicating the recess 68 with the return passage 50. The valve element 56 is movable from a load check position shown to an infinitely variable operating position. The radial passages 66 provide an infinitely variable pressure control orifice 72 through which fluid flows after it has passed through the metering orifice 54 with the size of the control orifice being determined by the extent to which the valve element 56 is moved from the load check position.

The valve 32 also includes a load piston 74 slidably disposed in the bore 46 in an end-to-end relationship with the valve element 56. A stem 76 of the piston extends into the recess 68 of the valve element 56 and is normally in engagement with the valve element. A variable volume chamber 78 is formed between the valve element and the piston and contains a lightweight load check spring 80 resiliently urging the valve element and load piston in opposite directions. A variable volume spring chamber 82 is formed by the piston and the body 34 and contains a compensator spring 84 therein. The compensator spring 84 exerts a greater force on the load piston 74 than the load check spring 80 and thus normally biases the load piston 74 into contact with the valve element 56 which is thereby biased to the load check position. A stop 86 is formed by the body to limit rightward movement of the load piston.

The transfer passage 48, the recess 64, the pressure control orifice 72, and the return passage 50 define a pressure control flow path 88 from the metering orifice 54 to one of the service passages 40,42, when the valve element 56 is at the operating position.

The metering orifice 54 and the pressure control flow path 88 define a flow control flow path 90 from the inlet port 36 to one of the service passages 40,42 when the valve member 52 and the valve element 56 are at operating positions.

A load signal network 92 includes a pair of signal lines 93,94, individually connected to the signal ports 44,45 of the control valves 22,27, a resolver 95 connected to the lines 93,94, and a control pressure line 96 connected to the resolver and to the spring chambers 82,83 and the displacement controller 19 of the pump 14. A control orifice 97 is disposed in the line 96. A load pressure relief valve 98 is connected to the line 96 downstream of the orifice 97.

INDUSTRIAL APPLICABILITY

In the use of the present invention, the operator can actuate one or both of the hydraulic motors 21,26 by manipulating the appropriate directional control valve 30,31. For example, if the operator wishes to extend the hydraulic motor 21, the valve member 52 of the directional control valve 30 is moved leftwardly to the operating position B. The timing relationship of the various ports and passages of the directional control valve 30 is typical of this type of system. More specifically, with this embodiment, the following events sequentially occur when the valve member 52 is moved to the position B. First of all, communication between the signal port 44 and the exhaust port 38 is blocked. Secondly, communication is established between the service passage 42 and the exhaust port 38. Thirdly, communication is established between the service passage 40 and the signal port 44. Then, communication is established between the service passage 40 and the return passage 50. Finally, orifice 54.

The establishment of co unication between the service passage 40 and the signal port 44 causes the load pressure in the motor conduit 23 to be transmitted through the signal line 93, the resolver 95, the control orifice 97, and into the control pressure line 96. The load pressure in the line 96 enters the chambers 82,83 where it acts on the pistons 74,75 in combination with the springs 84,85 to exert a greater biasing force momentarily holding both of the valve elements 56,57 in the load check position. The load pressure in the line 96 is also simultaneously transmitted to the displacement controller 19. If the load pressure is less than the setting of the relief valve 98, the pump 14 is immediately stroked to a displacement setting at which the pump discharge pressure in the supply conduit 18 is at a level greater than the load pressure in the motor conduit 23 by a predetermined margin pressure. The establishment of communication between the return passage 50 and the service passage 40 permits load pressure to enter the chamber 78 through the diagonal passage 70. Under this condition, the forces acting on the opposite ends of the piston 74 due to the load pressure is balanced so that the spring 82 maintains the piston 74 in contact with the valve element 56 which at this time is still in the load check position. The establishment of communication between the inlet port 36 and the transfer passage 48 transmits pressurized fluid from the supply conduit 18 through the metering orifice 54 and the transfer passage 48 where it acts on the end 58 of the valve element 56 causing it to move to an operating position. With both the valve member and the valve element 56 at the operating position, fluid passes through the flow control flow path 90, the service passage 40, the motor conduit 23, and into the motor 21 causing it to extend. The quantity or flow rate of fluid passing through the flow path 90 is determined by the size of the metering orifice 54 which in turn is determined by the extent to which the valve member is moved from the neutral position by the operator. Once such flow path is established, the pump will up-stroke to maintain the margin pressure. If the directional control valve 30 is the only valve at an operating position, the displacement controller 19 will maintain the margin pressure substantially constant regardless of the load being exerted on the hydraulic motor 21. Moreover, under this condition, the valve element 56 will reach a position at which the fluid flow through the metering orifice 72 equals the fluid flow passing through the metering orifice 54 with the pressure compensating valve 32 having little effect on the fluid passing therethrough.

If the operator now wishes to extend the motor 26 while the motor 21 is extending, the valve member 53 is moved leftwardly to the operating position B. If the load pressure in the motor conduit 28 is less than or equal to the load pressure in the motor conduit 23 or greater than the load pressure in the motor conduit 23 but less than the setting of the relief valve 98, leftward movement of the valve member 53 results in pressurized fluid being directed from the supply conduit 18 to the motor conduit 28 similarly to that described above with respect to the extension of the hydraulic motor 21. Under this condition, the higher of the load pressures will be transmitted to the control line 96 and the pressure compensating valves 32,33 function in the usual manner in cooperation with the displacement controller 19 to maintain the desired pressure differential across the metering orifices 54,55 so that the desired flow rates thereacross are achieved regardless of the loads acting on the motors. If the combined demand for fluid by the motors 21,26 is greater than the output of the pump 14, the pressure compensating valves proportion the flow according to the size of the metering orifices 54,55 in the usual manner.

In some hydraulic systems, the motors 21 and 26 are arranged such that extension of the motor 21 can induce a load pressure in the motor conduit 28 connected to the motor 26 greater than the setting of the relief valve 98. If the operator attempts to extend the motor 26 under this condition by moving the valve member 53 leftwardly to the operating position B, the higher load pressure from the conduit 28 passes through the signal port 45, the signal line 94, the resolver 95, the control orifice 97, and into the control pressure line 96. However, the higher load pressure opens the relief valve with the relief valve cooperating with the orifice 97 to lower the pressure in the control line 96 to a value substantially equal to the setting of the relief valve and thus becomes a modified load pressure. Such modified load pressure enters the chambers 82 and 83 and is transmitted to the displacement controller 19 in the usual manner. However, the actual load pressure in the conduit 28 is transmitted through the return passage 51, the passage 71, and into the chamber 79. Since the actual load pressure in the chamber 79 is greater than the modified load pressure in the chamber 83, the piston 75 is moved rightwardly against the stop 87 and the valve element 57 is held in the load check position. The pressure setting of the relief valve 98 is selected so that discharge pressure of the pump 14 is limited to a predetermined maximum pressure which is greater than the modified load pressure by the margin pressure. Thus, since the actual load pressure acting on the end 61 of the valve element 57 is greater than the pump discharge pressure acting on the end 59, the valve element will remain in the load check position to prevent reverse flow of fluid from the return passage 51 to the transfer passage 49.

In view of the above, it is readily apparent that the structure of the present invention provides an improved control valve in which the load check and pressure compensating valve includes a valve element and a load piston arranged in end-to-end relationship. The actual load pressure is directed between the valve element and the load piston while the modified load pressure is transmitted to the other end of the load piston. Thus, if the directional control valve member is moved to an operating position when the load pressure in the associated hydraulic motor is higher than the pump discharge pressure passing through the metering orifice and acting on the valve element, the valve element will be held in the load check position by the actual load pressure to thereby prevent reverse flow of fluid from the motor to the load check and pressure compensating valve.

Other aspects, objects, and advantages of this invention can be obtained from a study of the drawings, the disclosure, and the appended claims.

I claim:

1. A control valve for use in a hydraulic system having at least one other control valve therein, at least one hydraulic motor connected to each of the control valves, and a load pressure signal network operatively connected to the motors and having a control pressure line which receives the highest load pressure occurring at the motors, said control valve comprising:

an inlet port;

a pair of service passages connectable to the associated hydraulic motor;

a valve member movable in opposite directions from a neutral position to infinitely variable operating positions;

a load check and pressure compensating valve element movable from a load check position to an infinitely variable operating position;

means defining a flow control flow path from the inlet port to one of the service passages when the valve member and the valve element are at operating positions, the flow path including a metering orifice and a pressure control orifice disposed in series flow relationship downstream of the metering orifice with the size of the metering orifice being determined by the extent to which the valve member is moved from the neutral position and the size of the control orifice being determined by the extent to which the valve element is moved from the load check position, the valve element being moved to the operating position by fluid passing through the metering orifice;

a load piston normally biasing the valve element to the load check position;

a first variable volume chamber between the valve element and the load piston;

a second variable volume chamber defined in part by the load piston and adapted to be connected to the control pressure line;

a spring disposed in the second chamber biasing the load piston toward the valve element and hence the valve element to the load check position;

means for communicating load pressure from the one service passage into the first chamber.

2. The control valve of claim 1 wherein the valve element has opposite ends with one of the ends being subjected to the fluid pressure through the metering orifice.

3. The control valve of claim 2 including a spring disposed in the first chamber biasing the valve element and the load piston in opposite directions, the spring in the second chamber being stronger than the spring in the first chamber so that the load piston is normally in engagement with the valve element.

4. A load check and pressure compensating valve of the type disposed in series flow relationship between a metering orifice and a service passage connected to a hydraulic motor comprising:

a body having a bore therein;

a valve element slidably disposed in the bore and being movable between a load check position and an infinitely variable operating position;

means defining a pressure control flow path from the metering orifice to the service passage when the valve element is at the operating position, the flow path including a pressure control orifice with the size of the control orifice being determined by the extent to which the valve element is moved from the load check position, the valve element being moved to the operating position by fluid passing through the metering orifice;

a load piston normally biasing the valve element to the load check position;

a first variable volume chamber between the valve element and the load piston;

a second variable volume chamber formed between the load piston and the body;

a spring disposed in the second chamber biasing the load piston toward the valve element and hence biasing the valve element to the load check position;

means for communicating load pressure from the service passage into the first chamber.

5. The load check and pressure compensating valve of claim 4 wherein the valve element has opposite ends with one of the ends being subjected to the fluid pressure through the metering orifice.

6. The load check and pressure compensating valve of claim 5 including a spring disposed in the first chamber biasing the valve element and the load piston in opposite directions, the spring in the second chamber being stronger than the spring in the first chamber so that the load piston is normally in engagement with the valve element.

7. A hydraulic system having a plurality of hydraulic motors and a load sensing hydraulic pump having a displacement controller comprising:

a load pressure signal network operatively connected to the motors and having a control pressure line which receives the highest load pressure occurring at the motors, the control pressure line being connected to the displacement controller;

means for limiting the pressure of the fluid in the control pressure line to a predetermined maximum level;

a plurality of control valves each being connected to at least one of the motors, each of the control valves, including an inlet port connected to the pump;

a pair of service passages connected to the associated hydraulic motor;

a valve member movable in opposite directions from a neutral position to infinitely variable operating positions;

a load check and pressure compensating valve element movable from a load check position to an infinitely variable operating position;

means defining a flow control flow path from the inlet port to one of the service passages when the valve member and the valve element are at operating positions, the flow path including a metering orifice and a pressure control orifice disposed in series flow relationship downstream of the metering orifice with the size of the metering orifice being determined by the extent to which the valve member is moved from the neutral position and the size of the control orifice being determined by the extent to which the valve element is moved from the load check position, the valve element being moved to the operating position by fluid passing through the metering orifice;

a load piston normally biasing the valve element to the load check position;

a first variable volume chamber between the valve element and the load piston;

a second variable volume chamber defined in part by the load piston and being connected to the control pressure line;

a spring disposed in the second chamber biasing the load piston toward the valve element and hence biasing the valve element to the load check position; and means for communicating load pressure from the one service passage into the first chamber so that the valve element is held in the load check position when the load pressure in the one service passage is greater than the fluid passing through the metering orifice.

8. The control valve of claim 7 wherein the valve element has opposite ends with one of the ends being subjected to the fluid pressure through the metering orifice.

9. The control valve of claim 8 including a spring disposed in the first chamber biasing the valve element and the load piston in opposite directions, the spring in the second chamber being stronger than the spring in the first chamber so that the load piston is normally in engagement with the valve element.

* * * * *